United States Patent [19]

Blaas et al.

[11] Patent Number: 4,489,453

[45] Date of Patent: Dec. 25, 1984

[54] SEAMLESS, SELF-SUPPORTING WATERBED LINER UNIT AND METHOD OF MANUFACTURE

[75] Inventors: Wolfgang Blaas, Elk Grove Village; Friedrich Bergl, Chicago, both of Ill.; Judson D. Wetmore, Huntington Beach, Calif.

[73] Assignee: Hold-A-Fold, Inc., Chicago, Ill.

[21] Appl. No.: 384,373

[22] Filed: Jun. 2, 1982

[51] Int. Cl.[3] ..... A47C 27/08; B65D 5/36

[52] U.S. Cl. ..... 5/451; 4/580; 4/585; 150/49; 220/403

[58] Field of Search ..... 5/449–455; 156/226; 150/48, 49; 220/903, 904; 229/41 R; 4/480, 485–487

[56] References Cited

U.S. PATENT DOCUMENTS

| | | | |
|---|---|---|---|
| 2,878,488 | 3/1959 | Doskocil | 4/580 |
| 2,950,484 | 8/1960 | Jaffe | 150/49 |
| 3,856,064 | 12/1974 | Swallert | 150/49 |
| 4,393,531 | 7/1983 | Hodel | 5/451 |

FOREIGN PATENT DOCUMENTS

| | | | |
|---|---|---|---|
| 389447 | 9/1908 | France | 4/585 |
| 549998 | 10/1956 | Italy | 4/585 |

*Primary Examiner*—Alexander Grosz
*Assistant Examiner*—Michael F. Trettel
*Attorney, Agent, or Firm*—Jacques M. Dulin

[57] ABSTRACT

Seamless, free-standing, self-supporting waterbed safety liner formed into a prepackaged unit. Sheets of liner plastic are laid-out, the corners folded into hospital corners, and strips of rigid riser material are placed to overlap the folded corners a few inches and secured thereto. The riser material is then rotated 270° along their axes and bent along a medial score to bring the overlapped corner to the outside. Methods of folding the completed liner and installation are disclosed.

7 Claims, 16 Drawing Figures

FIG 4
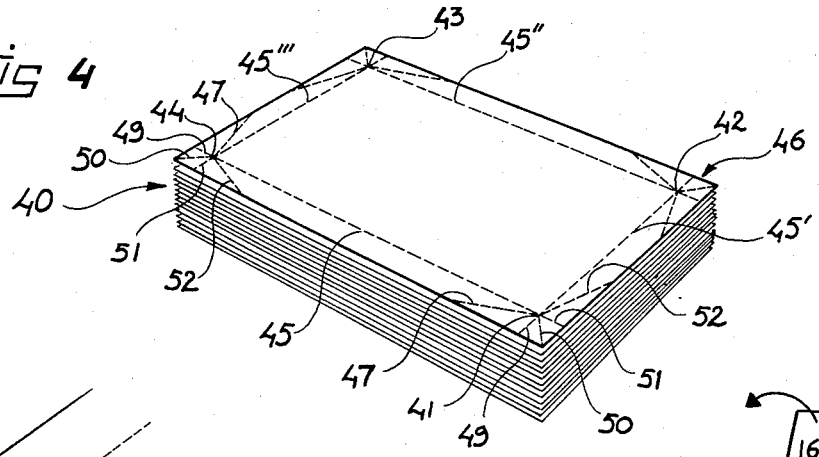
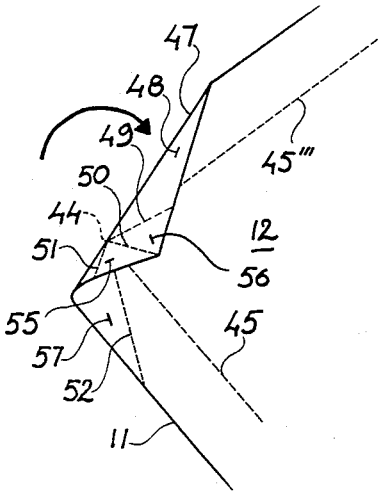
Fig.5(a)
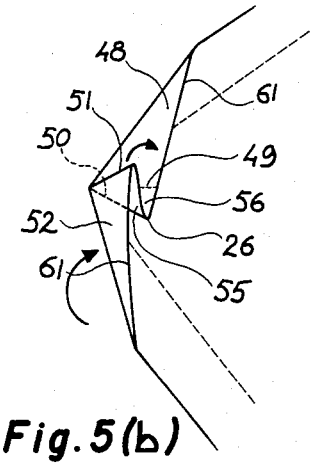
Fig.5(b)
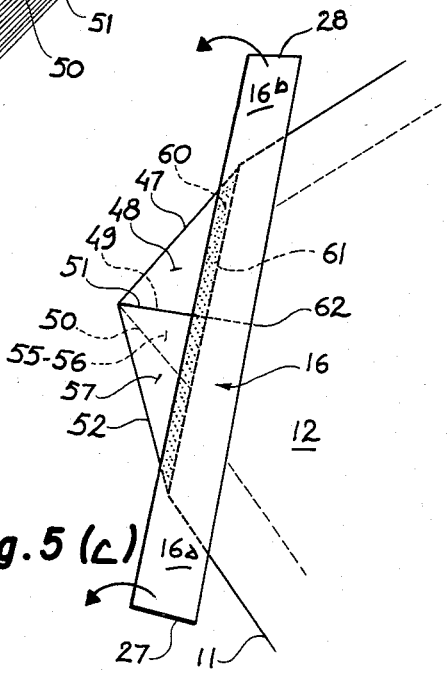
Fig.5(c)
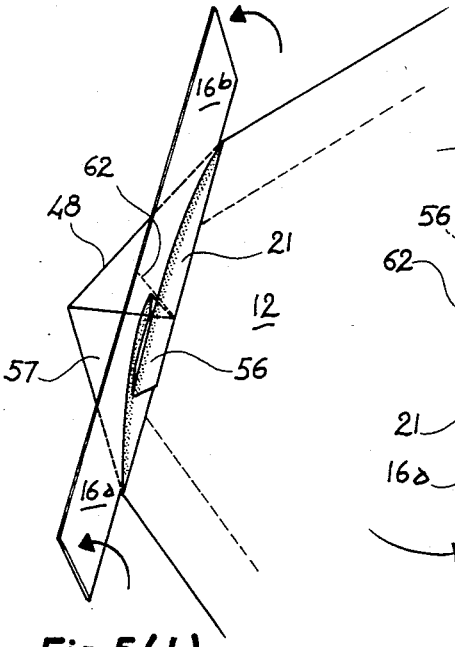
Fig.5(d)
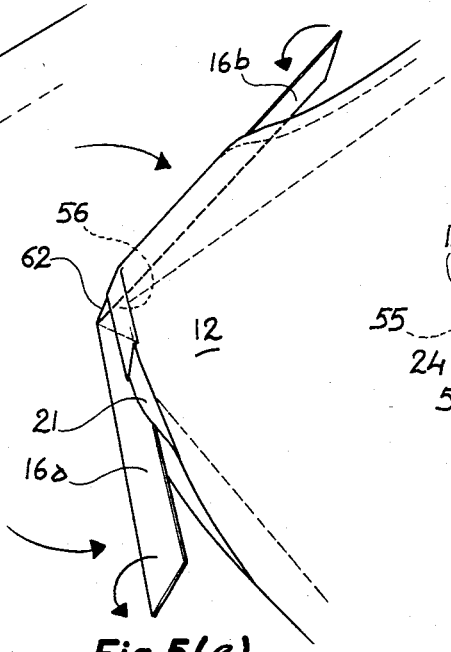
Fig.5(e)
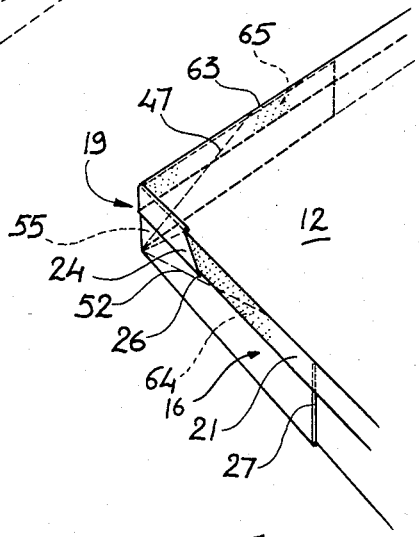
Fig.5(f)

SEAMLESS, SELF-SUPPORTING WATERBED LINER UNIT AND METHOD OF MANUFACTURE

FIELD

The invention relates to waterbed safety liners, and more particularly, a seamless, self-supporting waterbed liner and method of manufacture and folding for shipping.

BACKGROUND

Waterbeds today comprise a heavy vinyl mattress, usually of 20-gauge plastic, which is placed in a sturdy wood frame platform supporting a bed box comprising a continuous bottom of planks or plywood sheet and a substantial side rail perimeter frame. In the event the mattress is punctured, the water in the mattress could leak, damaging the bed frame, the floor, and other items wherever the water ran. Accordingly, a plastic safety liner sheet is usually disposed between the mattress and the frame sides and bottom before the mattress is installed and filled. This sheet is usually 8 mil vinyl plastic, and serves to contain any water which leaks from the mattress.

There are variety of methods of manufacture and installation of waterbed safety liners in current usage. First, regarding manufacture, a principal method involves welding the corners of the liner to form a box corner. An appropriately sized sheet of plastic is folded diagonally to form a triangle, and an induction welding machine is used to form a weld line along the two folded corners parallel to the two sides (not the hypotenuse) of the triangle, and the small triangular scraps are cut off and discarded as waste. The sheet is then folded diagonally the other way and induction welded to form the other two corners.

Second, as to installation, this corner-welded box liner is then shipped to the customer's installation site where a variety of installation methods are employed. Usually, the vertical sides of the safety liner are higher than the frame side. In one installation, the excess height is cut off, or folded over, below the side frame top edge, and taped in place. Alternately, the box liner may be stapled in place along its upper edge. Or, strips of wood may be nailed over the upper edge of the liner. Still another method involves cutting strips of cardboard from packing boxes, placing them adjacent the frame sides, tucking excess liner material over the top of the cardboard and between it and the frame sides, then securing it to the frame sides (by taping, tacking, or stapling through the liner and cardboard). In some instances such securing means are omitted, but keeping the liner in place while installing and filling the mattress is tricky.

Recently, the "Tuckaliner" (U.S. Pat. No. 3,973,282) has become employed as an installation device and method. The "Tuckaliner" is a strip of resilient material, e.g., a plastic, having a first rolled longitudinal edge, a second longitudinal flat edge, and a bowed portion therebetween. The strips of the "Tuckaliner" are cut in the field to the bed length and width, and installed by nailing or stapling it midway up the frame sides with the rolled edge at the upper edge desired for the top of the safety liner. The welded box corner liner is then fitted into the bed frame, and the excess of the side risers are tucked in behind the rolled edge of the "Tuckaliner."

The bow portion keeps the liner in place against the frame side by its spring action.

All these taping, tacking, stapling or cut cardboard field installations are time consuming, labor intensive, and therefore expensive. Further, where stapling or tacking is used, the liner is punctured below its upper edge, permitting some leakage possibilities.

A less field-labor intensive liner unit is the "Delta Star" type (made by Del Astra Industries, Stockton, CA). This is a welded, fitted liner that has rigid supporting strips self-contained in double side walls of plastic sheeting. The plastic sheeting completely surrounds the supporting strips, and the sheeting is then welded at the exterior bottom edge all around the periphery. Four or eight support strips are used, one or two along each side and the ends, and they are not joined at the corners. While this system is fast to install in the field, it is expensive to make as it requires more plastic sheeting, use of expensive welding equipment, and more factory labor.

Another field installation method involves making a hospital corner in the liner plastic at each corner of the bed frame followed by taping or stapling it to the bed frame. The hospital corner is a method of field forming a relatively neat corner as compared to a manufactured, induction-welded box corner. This corner forming and securing is field labor intensive and expensive. Field labor is usually more expensive than factory labor.

Accordingly, there is a need for a waterbed liner unit that can be easily made in the factory to precise dimensions, and which does not involve use of expensive induction welding equipment, yet which unit has free-standing, self-supporting side walls for easy and quick field installation, without the disadvantages of time and materials expense of employing securing means.

THE INVENTION

Objects

It is among the objects of this invention to provide a seamless, free-standing, self-supporting waterbed liner unit that is simple and inexpensive to make, and which can be easily folded into a convenient shipping size.

Another object is to provide a method of manufacture of a self-supporting waterbed liner unit which does not employ expensive plastic welding equipment.

Still further and other objects of the invention will be evident from the detailed description which follows.

THE DRAWINGS

The detailed description will be in reference to the drawings in which:

FIG. 4 is a perspective of a plurality of plastic sheets with folding lines indicated thereon;

FIGS. 5*a–f* illustrate in sequence the method of forming a corner; and

FIGS. 6*a–f* illustrate, in sequence from a–f, the method of folding the manufactured liner for shipping, and considering the sequence in reverse from f–a, the field method for set-up of the liner in the bed frame.

SUMMARY OF THE INVENTION

A seamless, self-supporting, free-standing waterbed safety liner is formed into a prepackaged unit by laying out flat sheets of liner plastic, folding the corners into a pair of triangular areas with a Z-fold hospital corner therebetween. Then a rigid strip of riser material is glued to the base of the triangular areas. The riser is then rotated 270° along its longitudinal axis to bring an overlap portion of the liner to the outside. The riser is scored (or two pieces are taped) to be bendable medially of its ends to form a right angle corner, with the tip of the hospital corner now lying on the outside of the riser and a few inches below the upper marginal edge of the riser. All four corners are done in the same manner to form the finished unit. This unit is then folded by bringing the gap between adjacent corner risers together along the center of the sides, and folding the pairs of corners together. The floor area of the liner is then wrapped tightly around the risers, and bagged for shipping. Field installation is "instant" in that the liner is simply taken from the bag, unrolled, unfolded, and the sides straightened. The liner is in position to receive the mattress bag. The liner unit is seamless, thus avoiding the need for expensive high-frequency induction welding machines. The liner unit is easy to install in the field as it is free-standing and self-supporting, resulting in negligible field set-up costs. The method of manufacture to form the corners and secure the riser thereto is simple, thus reducing labor costs.

DETAILED DESCRIPTION OF THE PREFERRED EMBODIMENTS

This description has reference to the accompanying figures which are illustrative and not limiting of the principles of the invention.

Figure 1:
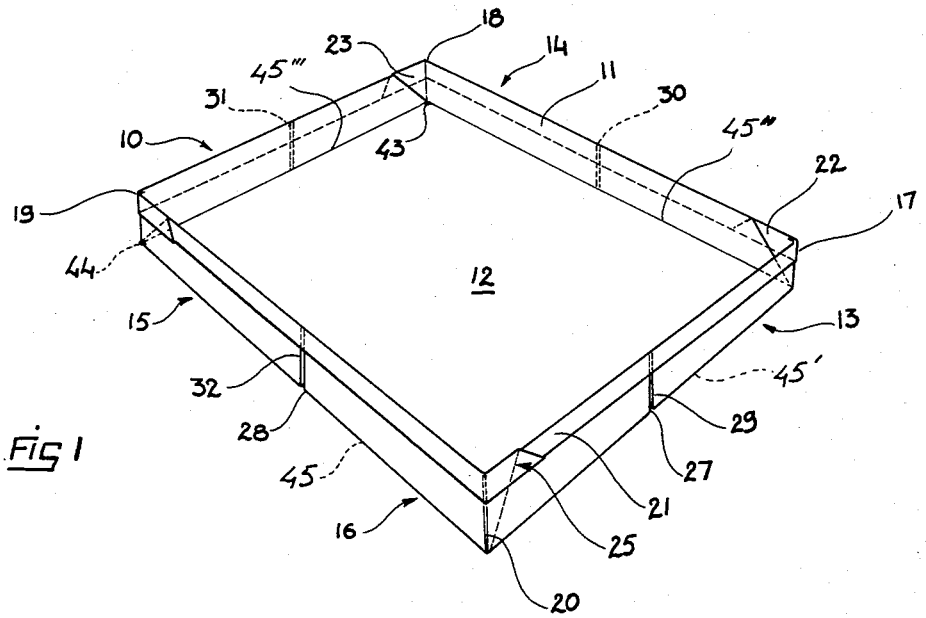
FIG. 1 is a perspective of the free-standing liner of this invention in its fully open position.

FIG. 1 shows in perspective a completed free-standing, self-supporting waterbed liner unit 10 comprising a sheet of plastic 11 which has defined therein a floor area 12 and four self-standing risers 13, 14, 15 and 16 around the perimetral edge 45 of the floor area 12. The risers comprise a rigid material, for example, 200-lb test corrugated cardboard, in the form of strips in which are folded medial their ends as at 17-20 to form the corners of the waterbed liner. The plastic sheet material 12 extends upwardly over the risers and is folded over the outside edge as shown at 21. Each corner has a reverse hospital fold as at 22-25. By way of example, the rigid material forming the risers may be on the order of 7–9 inches high. The liner may be glued to the upper outside edge of the rigid material forming the risers as best seen in FIG. 5*c*.

Figure 2:
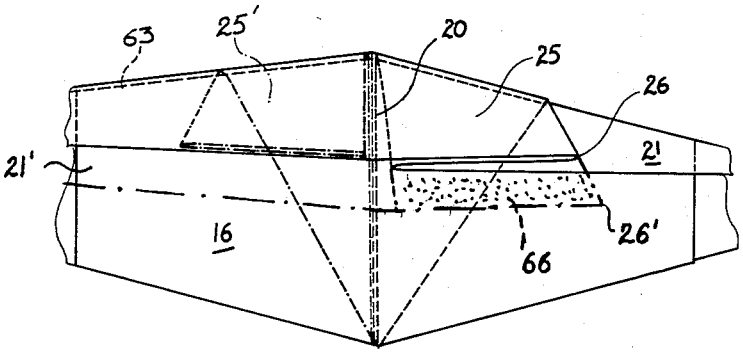
FIG. 2 is an exterior perspective of one corner of the liner showing the folded plastic corner.
Figure 3:
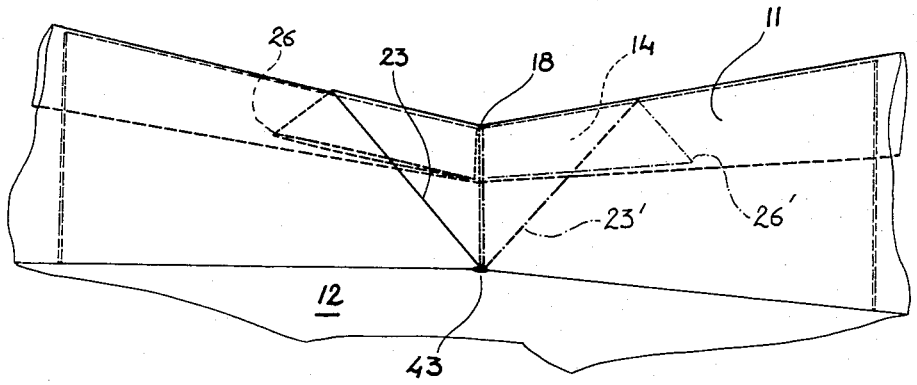
FIG. 3 is an interior perspective of one corner of the liner showing the folded plastic corner.

FIGS. 2 and 3 show the corner details. FIG. 2 is an exterior perspective view showing the diagonal fold 25 adjacent the corner 20 of the liner as it is lapped over the top edge 63 of the rigid riser material 16. FIG. 3 is a corresponding interior view showing the diagonal fold 23 forming a folded corner 18. It can be seen by comparing FIGS. 2 and 3 that any water which leaks out from a waterbed mattress contained in the space defined by the floor area 12 would not be able to leak outside as the corner is folded over, and the tip 26 of the corner is then trapped between the exterior of the waterbed liner and the inside of the waterbed frame (not shown). The corner fold can be reversed as seen at 25' and 23', that is, the fold tucked behind the plastic sheeting along the riser wall. We prefer to have end overlap 21' (FIG. 2) longer than side overlap 21 so that the tip 26' and lower edge of the corner fold 25 are secured by glue 66 to the riser material.

As can best be seen in FIG. 1, the risers may be formed from single sheets of rigid material, each of which is folded medial of its ends 27, 28 to form a corner such as corner 20. The gaps 29, 30, 31 and 32 permit folding of the entire unit as best seen in FIG. 6, and also provide for some adjustment for non-standard waterbed sizes.

We prefer to glue the waterbed liner to the risers as part of the manufacturing operation, but the exterior lip forming the overlap 21 may be stapled or otherwise secured to the risers in any other suitable manner. We prefer, however, to not have the staples run through onto the interior of the liner to prevent loss of sealing integrity.

Referring now to FIGS. 4 and 5, the invention also comprises a method of manufacture in which the corners are very simply formed, and which corners include the hospital folds as described above. The waterbed liner material may typically be a polyvinyl chloride plastic which comes in large rolls. The plastic is unrolled onto tables and cut off into a series of sheets of the appropriate size and formed into a stack 40 of sheets 11 (see FIG. 4). The sheets may be marked with corner identifying indicia, shown for simplicity in FIG. 4 as spots 41, 42, 43 and 44. These dots (which may be intersections of the lines as described below) represent the inside bottom corners of the waterbed liner. The lines 45, 45', 45'', 45''' spaced inwardly from the edge margins of the sheet 11 define the floor area 12 of the waterbed liner. For example, this line may be spaced inwardly approximately 9–10 inches from the exterior margins of the sheet 11. Then, at each corner, a plurality of fold guidelines 46 is indicated. We prefer to stencil or print the fold lines onto the plastic sheet to assist in the folding of the corner. In the alternative, a sheet of guide material with the lines printed thereon may be slipped under the corner of the sheet so that the guidelines are visible through the plastic.

Referring now to FIG. 5, in sequence from FIGS. 5*a–f*, a corner of the waterbed liner plastic is folded along first fold guideline 47 to form a triangular area 48. As can be seen in FIG. 5*a*, second fold line 49, third fold line 50, fourth fold line 51, and fifth fold line 52 are also identified thereon. The fold line 49 forms the corner fold line, that is, the vertical line which forms the inside corner, such as corner 18 as seen in FIG. 3.

It will be noted that the third fold line 50 is drawn between the corner spot and the adjacent corner of the sheet of plastic 11. It will be noted that the fold lines 49 and 51 are diagonal lines as shown in FIG. 5*a*, are essentially the extensions of the perimeter lines 45, 45', respectively, and they lie intermediate the fold lines 47 and 52. The fold lines 50 and 51 are chosen such that an appropriately sized hospital corner is made when the plastic is folded along those lines 50 and 52 (as best shown in FIG. 5*b*) so that fold line 51 is brought into alignment with fold line 49. As best seen in FIG. 5*c*, the resulting fold forms an isosceles triangle comprising areas 48 and 57 with the base line 61 extending diagonally across the original corner of the sheet 11. Glue 60 is applied, for example, with a brush or roller in a stripe approximately ½–2 inches wide adjacent the marginal edge 61. Thereafter, a rigid riser material, typically cardboard, is then laid down so that one longitudinal edge overlaps the edge 61 of the folded triangular area 48, 57 in contact with the strip of glue 60. This riser may be a single piece with a score 62 medial thereof and is placed such that the medial score is aligned with the fold line 51. In the alternative, two strips of cardboard are taped together on only one side (on the side facing the viewer as seen in *5c*), and aligned so that the transverse strip of tape joining the ends of the two strips 16*a* and 16*b* is in alignment with the fold line 51.

Thereupon, as best seen in FIGS. 5*d,e,f,* the rigid riser board to which the waterbed liner plastic is glued is then turned over 270° around its longitudinal axis and bent along the score or tape line 62 to form the corner 19 of the waterbed liner. This rotation and bending along the medial line 62 then forms the seamless, self-supporting safety liner for the waterbed. It will be noted that the glue line 60 is disposed on the surface of the overlapping portion 21 which contacts the outer surface of the riser 16 only as far as the intersection of lines 47 and 52 with the topmost edge 63 of the riser. Additional glue strips or areas, 64, 65 may be employed along the otherwise unglued areas if desired. This procedure is then repeated for the other three corners in a like manner.

In the alternative, the reverse fold shown in phantom in FIGS. 2 and 3 is formed by folding line 50 over line 49 so that tip 26 lies between lines 47 and 49. Further, a split difference fold may be made at the corners. In a split difference fold, there are basically two folds which extend partly along each of the two portions 16*a* and 16*b* of the riser from the corner 19. This split difference fold is in essence a double hospital corner which may be folded in the same manner as described above.

Figure 6A:
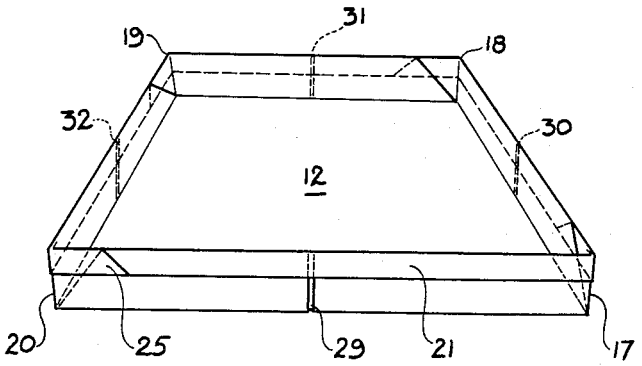
Figure 6B:
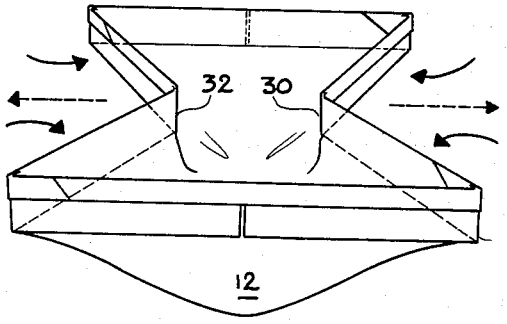
Figure 6C:
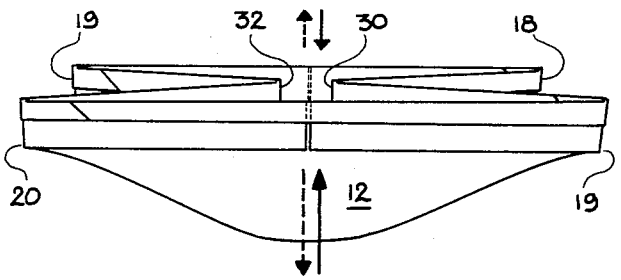
Figure 6D:
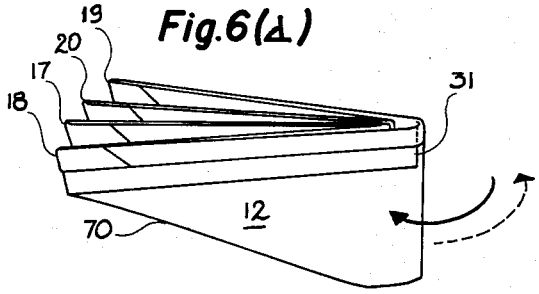
Figure 6E:
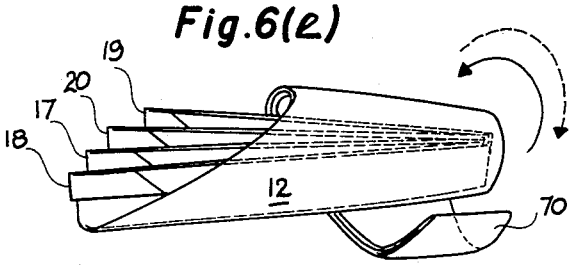

Turning now to FIG. 6, the completed waterbed liner as manufactured is illustrated in FIG. 6*a*. To fold the completed liner for shipping, the two sides are pushed inwardly toward each other as shown by the arrows at the gaps 30 and 32 between the riser sections. This is shown in FIG. 6*b*. The ends are then brought together as shown by the arrows in FIG. 6*c* trapping the midpoints 30 and 32 therebetween. The liner material hangs down in a truncated pyramid. The two corners 17 and 18 are then grasped and folded over to match the corners 20 and 19 as best seen in FIG. 6*d*. The resulting truncated triangular gathering 70 of the waterbed liner 12 is then wrapped around the stacked group of risers 17–20 as seen in FIG. 6*e*. The completely folded waterbed liner unit 75 is shown in FIG. 6*f*. This completely folded liner may then be put in a plastic bag for ease of shipping.

Figure 6F:
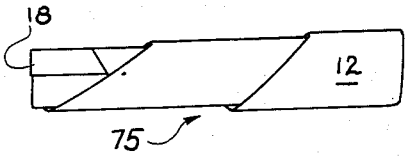

In the field, the installer receives the folded and bagged seamless safely liner for the waterbed in the configuration of FIG. 6*f*. Reversing steps 6*e–a*, the installer unrolls the floor portion of the liner as seen by the dashed arrows in FIGS. 6*e–6b*. This may be unrolled in the bottom of the actual waterbed frame, and the resulting instantly set-up liner which is free-standing, self-supporting and seamless is seen in FIG. 6*a*. The waterbed mattress may thereafter be placed on the floor area 12 of the liner and filled with water to complete the installation. As can be seen from the above description, we are able to eliminate the use of a high-frequency induction welding machine which is currently being used in the manufacture of the welded box corners and in the Delta Star type welded corner fitted liner that has supporting strips welded into the liner. We are also able to eliminate the field labor of cutting cardboard, tacking, stapling or taping the support, and tucking the liner behind the supports or behind the Tuckaliner type of liner retaining strips.

In the alternative to gluing the liner to the riser material, the fold tip 26 and the overlap strip 21 may be stapled to the outside of the riser, or taped thereto. In still another embodiment, the fold 24 and overlap 21 may be inserted in vertical slots cut in the upper 2 or 3 inches of the liner spaced along the topmost edge 63.

It should be understood that various modifications within the scope of this invention can be made by one of ordinary skill in the art without departing from the spirit thereof. We, therefore, wish our invention to be defined by the scope of the claims as broadly as the prior art will permit and in view of this specification.

We claim:

1. An improved, seamless waterbed safety liner assembly comprising:

(a) a continuous sheet of plastic having a floor area defined centrally thereof, (b) upstanding perimetral walls along the margins of said floor area and defining therebetween an interior volume for receiving a waterbed mattress, (c) said upstanding perimetral walls comprising a plurality of strips of rigid sheet material risers having an inner face facing said floor area, an outer face, and a top edge, and margins of said plastic sheet being draped up the sides of said inner face, over said top edge and overlapping a limited portion of the outside face of said risers, (d) said plastic sheet being secured to said risers, and (e) seamless corners formed in said sheet including at least one z-fold triangular hospital corner having a tip, said z-fold sheet corner being disposed interiorly with respect to said interior face of said riser, and said tip being disposed as part of said overlap along the exterior face of said riser.

2. An improved, seamless waterbed safety liner as in claim 1 wherein said adjacent risers are secured to each other at said corners, and are dimensioned to have gaps therebetween along one or more sides of said floor area to permit folding of said liner.

3. An improved, seamless waterbed safety liner as in claim 2 wherein said risers are continuous at said corners, and said corners are formed by vertical score lines in said riser material.

4. An improved, seamless waterbed safety liner as in claim 3 wherein said liner is secured to the upper margin of the outside face of said riser by glue.

5. An improved, seamless waterbed safety liner as in claim 4 wherein said riser is cardboard.

6. An improved, seamless waterbed safety liner as in claim 2 wherein said risers are joined at said corners with flexible tape.

7. An improved, seamless waterbed safety liner as in claim 2 wherein said risers are disposed in a stacked relationship, and the floor area plastic is wrapped around said stacked risers to permit bagging and shipping in a minimum volume folded condition for immediate set-up under field installation conditions.

* * * * *